United States Patent [19]

Savard et al.

[11] 4,315,774

[45] Feb. 16, 1982

[54] METHOD OF SAFELY INJECTING OXYGEN REACTIVE MATERIALS INTO A SUBMERGED OXYGEN GAS STREAM

[75] Inventors: Guy Savard, Westmount; Robert G. H. Lee, Montreal, both of Canada

[73] Assignees: Canadian Liquid Air Ltd.; Air Liquide Canada Ltée., both of Montreal, Canada

[21] Appl. No.: 194,621

[22] Filed: Oct. 6, 1980

[30] Foreign Application Priority Data

Oct. 31, 1979 [CA] Canada ..... 338906

[51] Int. Cl.[3] ..... C22B 23/02; C22B 15/06

[52] U.S. Cl. ..... 75/74; 75/23; 75/82; 75/92

[58] Field of Search ..... 75/51, 52, 72, 73, 74, 75/75, 77, 82, 23, 92

[56] References Cited

U.S. PATENT DOCUMENTS

| | | | |
|---|---|---|---|
| 3,281,237 | 10/1966 | Meissner et al. | 75/77 |
| 3,892,559 | 7/1975 | Quarm | 75/72 X |
| 4,045,215 | 8/1977 | Leroy et al. | 75/82 |
| 4,080,197 | 3/1978 | Meissner et al. | 75/77 |
| 4,130,417 | 12/1978 | Breuer | 75/51 |
| 4,171,216 | 10/1979 | Leroy | 75/77 |

*Primary Examiner*—M. J. Andrews

*Attorney, Agent, or Firm*—Bachman and LaPointe

[57] ABSTRACT

In the refining of metal in a bath of the molten metal, oxygen is injected into the molten metal in a stream adjacent to a stream of a protective fluid which conveys a particulate flux, which is reactive with oxygen, into the molten metal; in this way the oxygen and particulate flux are safely introduced into the interior of the molten metal.

10 Claims, No Drawings

METHOD OF SAFELY INJECTING OXYGEN REACTIVE MATERIALS INTO A SUBMERGED OXYGEN GAS STREAM

BACKGROUND OF THE INVENTION (i) Field of the Invention

This invention relates to the smelting of metal with oxygen.

(ii) Description of the Prior Art

U.S. Pat. No. 3,706,549, the teaching of which is hereby incorporated herein by reference describes the injection of oxygen into a bath of molten metal from below the bath surface in the refining of pig-iron to steel, such that accelerated erosion of the refractory used to line the container of the bath is prevented.

The oxygen injector, which extends through the refractory wall lining of the container, comprises two concentric tubes. The inner tube is used for the injection of oxygen and the annular space between the inner tube and the outer tube is for applying a protective fluid. The fluid which is usually a hydrocarbon, is employed to shield the oxygen from the reactive molten metal at the interface of the refractory wall and the molten metal and ensures that the vigorous reaction with the molten metal takes place away from the refractory wall. The resultant delay in the exothermic reaction between the oxygen and the molten metal is sufficient to maintain the integrity of the refractory wall.

It is also known, in the refining of pig iron to steel, to introduce a flux to the oxygen stream enabling the flux, the molten metal and oxygen gas to be in close proximity for efficient flux utilization and for efficient refining of the molten pig iron.

The fluxes conventionally used in the refining of pig iron to steel, which fluxes include lime, spar and dolomite, are not reactive to oxygen gas and hence pneumatic transfer of the flux in the gaseous oxygen stream is acceptable.

In the case of fluxes which are reactive with oxygen, it is not safe to pneumatically convey the flux in an oxygen stream.

In the direct smelting of lead sulphide concentrates, as described in U.S. Pat. No. 3,281,237 - Meissner, the teaching of which is hereby incorporated herein by reference, particulate lead sulphide is pneumatically conveyed with air into a molten lead bath with the appropriate ratio of oxygen in the air to carry out the smelting reaction.

It would be extremely hazardous to pneumatically convey the particulate lead sulphide concentrate in an oxygen stream because of the highly explosive nature of the mixture.

It is an object of this invention to provide a method of pneumatically introducing a metal ore which is reactive with oxygen into a molten metal simultaneously with the injection into the molten metal of oxygen.

SUMMARY OF THE INVENTION

In accordance with the invention there is provided a method of smelting metal in a bath of molten metal comprising injecting oxygen into said molten metal in a stream adjacent to a stream of a protective fluid, and conveying a particulate metal ore into said molten metal in said stream of protective fluid.

In particular the adjacent streams may be in contact along their length, one stream being surrounded by the other.

In particular the metal ore is one which is reactive or oxidizable with oxygen in the absence of a diluent gas such as nitrogen, or forms an explosive mixture with a gas which consists essentially of oxygen.

Employing the method of the invention the metal ore and oxygen are conveyed directly to the oxygen reaction zone within the molten metal, whereby the smelting can proceed efficiently and safely without significant erosion of the refractory lining of the molten metal bath.

The oxygen stream may be surrounded by said stream of protective fluid or the stream of protective fluid may be surrounded by the oxygen stream. In the case of the latter the oxygen stream is suitably surrounded by a second stream of protective fluid so as to maintain the integrity of the refractory lining of the molten metal bath.

DESCRIPTION OF THE PREFERRED EMBODIMENT

The protective fluid may be, for example, a hydrocarbon, particularly a gaseous hydrocarbon, $SO_2$, CO, $CO_2$, $N_2$, $H_2O$ or argon, but any fluid which is substantially inert in the reaction and will not interfere with the refining can be employed.

The method has particular applicability to the smelting of lead, nickel, cobalt and copper from their sulphide concentrates, respectively, but it can be employed for the smelting of other metal minerals which are dangerously reactive in an oxygen stream.

The use of air, however, has the disadvantage that it necessitates additional heat to carry out the smelting reaction so that the economics of the process are unfavourable.

In particular, for a lead sulphide concentrate containing the following major components in weight %

72% Pb
15% S
1% Cu
3% Fe
3% $CO_2$ 1 lb. of concentrate requires 2 cu. ft. of oxygen to complete the smelting operation. In carrying out the submerged smelting reaction the concentrate is pneumatically conveyed into the oxygen reaction zone situated within a molten lead bath. In accordance with the invention this is achieved safely by conveying the concentrate in a stream of protective gas surrounding the oxygen stream. The quantity of protective gas needed to convey one pound of the concentrate is suitably in the range of 0.1 to one or more cu. ft.

The amount of protective gas can be widely varied, and the quantity used can thus be selected to maintain the desired heat balance and still be in the range for proper pneumatic transport.

In another embodiment of the invention the injector comprises three tubes spaced concentrically.

The inner-most tube is employed to convey the metal ore in an inert gas, such as a protective fluid as described previously. The annular space between the inner tube and the intermediate tube is for the oxygen gas to carry out the smelting reaction and the annular space between the intermediate tube and the outer tube is used in conjunction with a protective fluid to maintain the integrity of the refractory wall which is employed to line the container for the molten metal bath.

We claim:

1. A method of smelting metal in a bath of the molten metal comprising injecting oxygen into said molten metal in a stream adjacent to a stream of a protective fluid, said stream of protective fluid surrounding said stream of oxygen and conveying an ore of said metal, said ore being reactive with oxygen, in a particulate form into said molten metal in said stream of protective fluid.

2. A method according to claim 1, wherein said metal is lead and said ore is lead sulphide.

3. A method according to claim 1, wherein said metal is selected from the group consisting of copper, cobalt and nickel and said ore is a sulphide of said metal.

4. A method according to claim 1, wherein said protective fluid is a hydrocarbon.

5. A method according to claim 1, wherein said protective fluid is selected from the group consisting of nitrogen, argon, carbon dioxide, water, carbon monoxide and sulphur dioxide.

6. A method of smelting metal in a bath of the molten metal comprising injecting oxygen into said molten metal in a stream adjacent to a first stream of a protective fluid, and conveying an ore of said metal, said ore being reactive with oxygen, in a particulate form into said molten metal in said first stream, said stream of oxygen surrounding said first stream, and injecting a second stream of protective fluid into said molten metal, said second stream surrounding said stream of oxygen.

7. A method according to claim 6, wherein said metal is lead and said ore is lead sulphide.

8. A method according to claim 6, wherein said metal is selected from the group consisting of copper, cobalt and nickel and said ore is a sulphide of said metal.

9. A method according to claim 6, wherein said protective fluid is a hydrocarbon.

10. A method according to claim 6, wherein said protective fluid is selected from the group consisting of nitrogen, argon, carbon dioxide, water, carbon monoxide and sulphur dioxide.

* * * * *